US005690371A

United States Patent [19]

Turnbull

[11] Patent Number: 5,690,371

[45] Date of Patent: Nov. 25, 1997

[54] FUSED SPRING LATCH

[75] Inventor: William C. Turnbull, Colorado Springs, Colo.

[73] Assignee: Schlage Lock Company, San Francisco, Calif.

[21] Appl. No.: 742,643

[22] Filed: Nov. 1, 1996

Related U.S. Application Data

[63] Continuation of Ser. No. 342,471, Nov. 21, 1994, abandoned.

[51] Int. Cl.[6] ..... E05C 1/08

[52] U.S. Cl. ..... 292/163; 292/DIG. 66

[58] Field of Search ..... 292/163, 335, 292/DIG. 65, DIG. 66

[56] References Cited

U.S. PATENT DOCUMENTS

| | | | |
|---|---|---|---|
| 3,183,027 | 5/1965 | Powers | 292/40 |
| 3,197,247 | 7/1965 | Russell | 292/163 |
| 3,325,941 | 6/1967 | Prucha | 49/7 |
| 3,705,739 | 12/1972 | Adler | 292/92 |
| 3,811,717 | 5/1974 | Floyd et al. | 292/92 |
| 3,825,289 | 7/1974 | Armstrong | 292/163 |
| 4,003,593 | 1/1977 | Wilzig et al. | 292/92 |
| 4,005,886 | 2/1977 | Lirette | 292/177 |
| 4,007,954 | 2/1977 | Erickson | 292/165 |
| 4,012,066 | 3/1977 | Salvatore | 292/341.13 |
| 4,015,869 | 4/1977 | Horvath | 292/341.16 |
| 4,099,753 | 7/1978 | Gwozdz et al. | 292/177 |
| 4,145,900 | 3/1979 | Ohno | 70/92 |
| 4,161,894 | 7/1979 | D'Hooge et al. | 16/48.5 |
| 4,183,565 | 1/1980 | Alleman | 292/163 |
| 4,272,111 | 6/1981 | Hammer, Jr. et al. | 292/DIG. 66 X |
| 4,311,329 | 1/1982 | Kral | 292/92 |
| 4,437,693 | 3/1984 | Godec | 292/191 |
| 4,598,939 | 7/1986 | Krupicka et al. | 292/92 |
| 4,627,498 | 12/1986 | Aalto et al. | 169/42 |
| 4,714,285 | 12/1987 | Langham | 292/163 |
| 4,726,613 | 2/1988 | Foshee | 292/DIG. 66 X |
| 4,824,150 | 4/1989 | Smith et al. | 292/92 |
| 4,865,367 | 9/1989 | Choi | 292/92 |
| 4,867,496 | 9/1989 | Thomas | 292/341.16 |
| 5,121,950 | 6/1992 | Davidian | 292/164 |
| 5,147,351 | 9/1992 | Wagner | 292/DIG. 66 X |
| 5,380,053 | 1/1995 | Saino | 292/144 |
| 5,427,420 | 6/1995 | Moore | 292/DIG. 66 X |

*Primary Examiner*—Rodney M. Lindsey
*Attorney, Agent, or Firm*—Robert F. Palermo; Michael H. Minns

[57] ABSTRACT

A first platform having fingers rising therefrom is interengaged with a second, fusible platform in a spring latch assembly. The second holds the first at an angle in which the fingers avoid notches formed in the tail of the latch bolt. When the fusible platform melts due to excessive heat, the fingered platform assumes a normal horizontal disposition, and the fingers engage the notches in the tail to prevent the latch bolt from retracting.

6 Claims, 2 Drawing Sheets

FUSED SPRING LATCH

This application is a continuation of application Ser. No. 08/342,471, filed Nov. 21, 1994, now abandoned.

BACKGROUND OF THE INVENTION

This invention pertains to spring latches, and in particular to a spring latch which is fused to prevent unlatching, i.e., latch bolt retraction, in the presence of excessive heat.

Fusible or thermally-responsive latching devices are well known in the prior art, and exemplary thereof, perhaps, is the device and method set out in U.S. Pat. No. 4,437,693, issued on 20 Mar. 1984, to M. Godec, for a Thermally Responsive Latching Device and Method of Modifying a Latching Device. This patented concept, the same as the instant invention, has particular pertinence for fire doors. The patented concept concerns a panic exit type of latching device, whereas the instant invention concerns a simple, spring latch.

In one aspect of the invention it is intended to disclose an arrangement in which the very fusible element, itself, is employed to insure that the latch-retracting blocking means is held away from the latch bolt until the spring latch is subjected to excessive heat. In another aspect of the invention it is shown how to use the normal, latch bolt biasing spring to dispose the latch-retracting blocking means into obstruction of the latch bolt, whereby retraction of the latter is prevented.

The foregoing illustrates limitations known to exist in present devices and methods. Thus, it is apparent that it would be advantageous to provide an alternative directed to overcoming one or more of the limitations set forth above.

SUMMARY OF THE INVENTION

This is accomplished by a fused, spring latch, comprising: a housing; a latch bolt, having a bolt head and an elongated tail, slidably disposed in said housing; means for biasing said latch bolt to maintain said bolt head projected from said housing and for resisting retraction of said bolt head into said housing; and thermally responsive means, within said housing for blocking said tail and preventing retraction of said head into said housing.

The foregoing and others aspects will become apparent from the following detailed description of the invention when considered in conjunction with the accompanying drawing figures.

DETAILED DESCRIPTION

Figure 1:
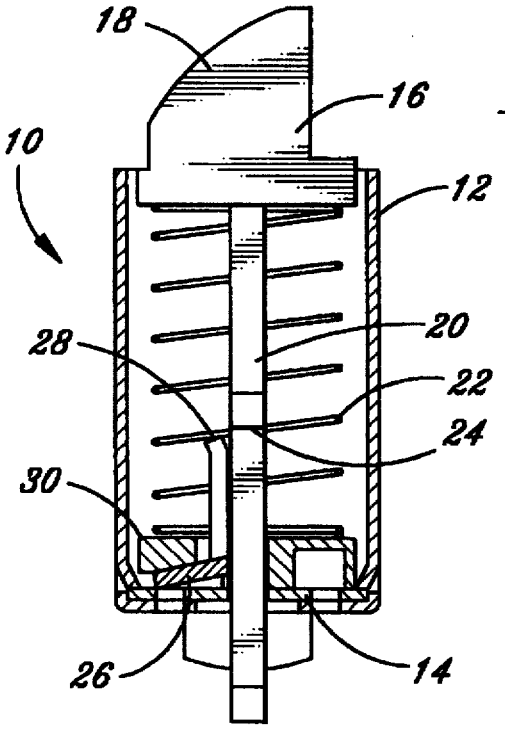
FIG. 1 is an axial, cross-sectional view of the novel, fused, spring latch, according to an embodiment thereof.
Figure 2:
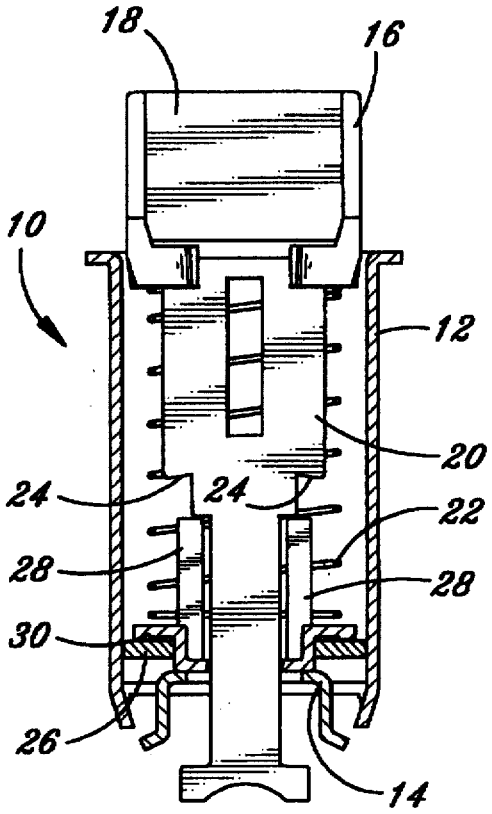
FIG. 2 is a view, like that of FIG. 1 in which, however, the cross-section is rotated ninety degrees of arc.

As shown in FIGS. 1 and 2, the novel, fused, spring latch 10 comprises a housing 12 which, at one end thereof, has a land 14. Slidably confined within the housing 12 is a latch bolt 16, the same having a bolt head 18 and an elongated tail 20. A compression spring 22 is set about the tail 20, having one end biasingly engaged with the head 18. In the prior art, such a spring latch would have the other end of the compression spring biasingly engaged with the land 14. However, in this embodiment of the invention, novel, functional platforms are interposed between the spring 22 and the land 14.

Figure 3:
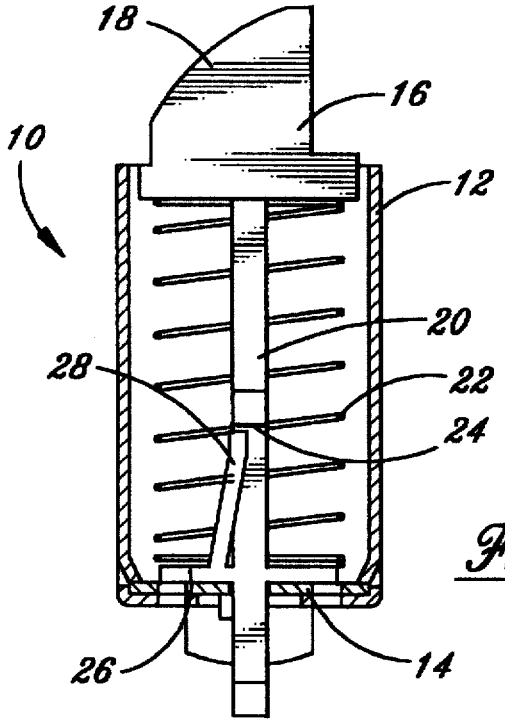
FIG. 3 is a view similar to that of FIG. 1 in which, however, the fusible platform has fused, and the blocking finger has engaged the tail of the latch bolt.

The tail 20 of the latch bolt 16 has a pair of notches 24 formed therein. A first platform 26 has integral therewith a pair of fingers 28 which, as evidenced in FIGS. 1 and 2, are astride, albeit parallel with, the tail 20. Platform 26 is inclined, i.e., disposed at an angle in a first orientation relative to the land 14, because of its interengagement with a second platform 30. The second platform 30 is formed of fusible material so that, in the presence of excessive heat, it would fuse. Upon fusion of platform 30, platform 26 will set horizontally on the land 14 in a second orientation, and interpose the fingers 28 in obstruction of the notches 24. This is shown in FIG. 3; the platform 30 has fully fused, and the spring 22 has seated the platform 26 fully upon the land 14.

Figure 4:
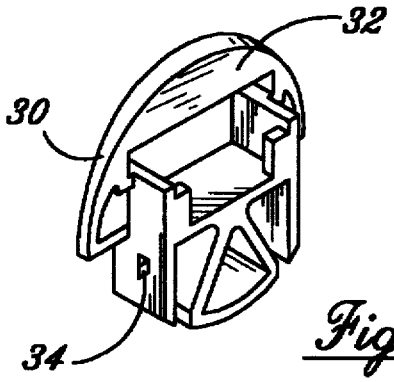
FIG. 4 is a perspective depiction of the fusible platform.

FIG. 4 depicts the platform 30, in perspective. As can be seen, it has a wedge-shaped portion 32 which cooperates with a pair of ears 34 (only one is visible in FIG. 4), one on each side of the platform 30 to define guide means for slidably interengaging platform 26 therewith.

Figure 5:
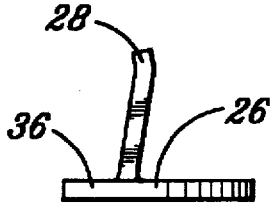
FIGS. 5, 6, and 7 are different views of the fingered platform.
Figure 6:
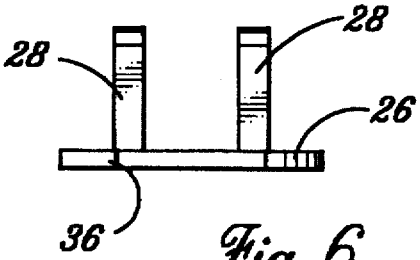
Figure 7:
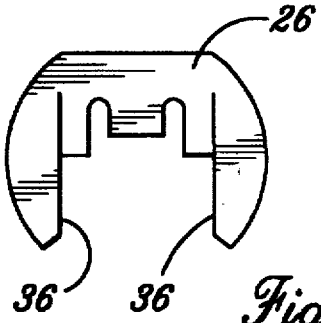
Figure 8:
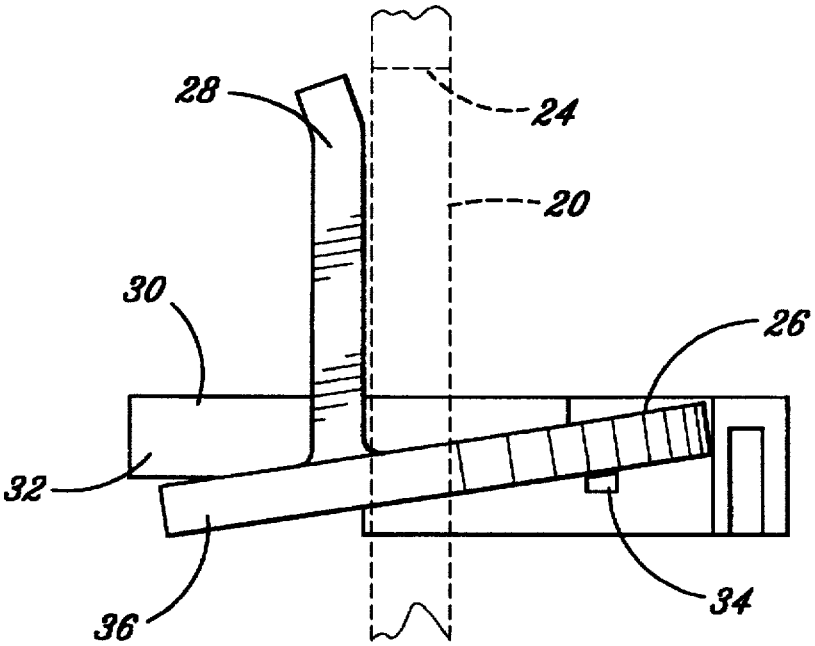
FIG. 8 is a side elevational view of the interengaged fusible and fingered platforms.

FIG. 5 is a side elevational view of the fingered platform 26. It can be clearly seen that the fingers 28 are acutely angled relative to the planar portion 36 of the platform 26. It is because of this that the fingers 28 avoid obstructing the tail 20, and repose in parallel therewith, while the fusible platform 30 retains its integrity. FIG. 6 is an elevational view of the platform 26 taken from the left-hand side of FIG. 5, and FIG. 7 is bottom view of the platform 26. The platform 26 is centrally relieved, to accommodate the tail 20 therethrough. In addition, the platform 26 has a pair of mutually facing, parallel edges 36 which slidably fit into the guide means of the platform 30. Edges 36 slidably move upon the ears 34 to interengage the two platforms, as shown in FIG. 8, to dispose the platform 26 at an angle relative to the land 14, as aforesaid, and to hold the fingers 28 unobstructably away from the tail notches 24.

Clearly, when the platform 30 disappears, i.e., melts in the presence of excessive heat, the spring 22 forces the planar portion 36 of the platform 26 to seat upon the land 14 and present the ends of the fingers 28 to the notches 24. Accordingly, the bolt head 18 will be prevented from retracting into the housing 12.

While I have described my invention in connection with a specific embodiment thereof, it is to be clearly understood that this is done only by way of example, and not as a limitation to the scope of the invention as set out in the aspects thereof and in the appended claims.

What is claimed is:

1. A spring latch assembly for fusible dead bolting by excessive temperature, comprising:

a housing having a land in an end thereof;

a latch bolt, having a bolt head and an elongated tail, slidably disposed in said housing;

means for biasing said latch bolt to maintain said bolt head projected from said housing and to resist retraction of said bolt head into said housing; and thermally-responsive means within said housing for disabling the latch bolt by blocking said tail and preventing retraction of said bolt head into said housing after exposure of the latch assembly to excessive temperature, said thermally-responsive means comprising a platform having at least one elongated finger, and a heat-fusible means, set upon said land and providing support for said platform to maintain said finger axially oriented in said housing and out of engagement with said latch bolt tail until said heat-fusible means is fused by excessive temperature.

2. A spring latch assembly according to claim 1 wherein said means for biasing comprises a compression spring; a first end of said spring being engaged with said bolt head, and a second end of said spring engaging said platform when said heat-fusible element is fused.

3. A fused spring latch assembly comprising:

a latch housing having a land at one end thereof;

a latch bolt slidably disposed in said latch housing for movement between a retracted position and a projected position;

a platform having a planar portion with at least one finger extending from said planar portion for selective engagement with said bolt to permit movement of said bolt to said retracted position when said platform is in a first orientation relative to said land and prevent movement of said bolt to said retracted position when said platform is in a second orientation relative to said land;

a heat-fusible element having at least a first part disposed between said platform and said land for holding said platform in said first orientation such that said finger does not engage said bolt; and, a compression spring for biasing said latch bolt toward said projected position and urging said heat-fusible element toward said land, said compression spring engaging said planar portion of said platform upon fusion of the heat-fusible element to move said platform to said second orientation.

4. A fused spring latch assembly as claimed in claim 3 wherein, prior to fusion of said heat-fusible element, said heat-fusible element has a first surface abutting said land and a second surface against which said compression spring presses.

5. A first spring latch assembly as claimed in claim 3 wherein said heat-fusible element has at least one ear for engaging said platform to hold said platform in said first orientation relative to said land until said heat-fusible element is fused.

6. A fused spring latch assembly as claimed in claim 3 wherein said bolt comprises a bolt head and an elongated tail extending from said bolt head, said compression spring engaging said bolt head, said tail having an engaging surface thereon which is engageable by said finger only upon fusion of said heat-fusible element.

* * * * *